US006497952B1

(12) United States Patent
Ohkoshi et al.

(10) Patent No.: US 6,497,952 B1
(45) Date of Patent: Dec. 24, 2002

(54) HIGH-STRENGTH SYNTHETIC FIBER AND METHOD AND APPARATUS FOR FABRICATING THE SAME

(75) Inventors: Yutaka Ohkoshi, Ueda (JP); Toshifumi Ikaga, Ueda (JP); Wataru Okumura, Ueda (JP); Atsushi Kobayashi, Ueda (JP); Takayoshi Yamaguchi, Ueda (JP)

(73) Assignee: Ueda Textile Science Foundation (JP)

( * ) Notice: Subject to any disclaimer, the term of this patent is extended or adjusted under 35 U.S.C. 154(b) by 59 days.

(21) Appl. No.: 09/743,514

(22) PCT Filed: May 31, 2000

(86) PCT No.: PCT/JP00/03498

§ 371 (c)(1),
(2), (4) Date: Jan. 11, 2001

(87) PCT Pub. No.: WO00/73556

PCT Pub. Date: Dec. 7, 2000

(30) Foreign Application Priority Data

| | | |
|---|---|---|
| May 31, 1999 | (JP) | 11-189473 |
| Jun. 23, 1999 | (JP) | 11-214140 |
| Jul. 14, 1999 | (JP) | 11-231843 |
| Oct. 12, 1999 | (JP) | 11-325878 |
| Oct. 12, 1999 | (JP) | 11-325879 |
| Oct. 28, 1999 | (JP) | 11-345187 |

(51) Int. Cl.[7] ..... D02G 3/00
(52) U.S. Cl. ..... 428/364
(58) Field of Search ..... 428/364, 395; 528/309

(56) References Cited

U.S. PATENT DOCUMENTS

| | | | | |
|---|---|---|---|---|
| 4,101,525 A | * | 7/1978 | Davis et al. | 528/309 |
| 5,567,796 A | * | 10/1996 | Nakatsukasa et al. | 528/272 |

FOREIGN PATENT DOCUMENTS

| | | |
|---|---|---|
| DE | 3431747 A1 | 5/1986 |
| JP | 48-85808 | 11/1973 |
| JP | 61-75811 | 4/1986 |
| JP | 61-207635 | 9/1986 |
| JP | 63-249732 | 10/1988 |

* cited by examiner

*Primary Examiner*—N. Edwards
(74) *Attorney, Agent, or Firm*—Parkhurst & Wendel, L.L.P.

(57) ABSTRACT

A high-strength synthetic fiber is fabricated in such a way that a fiber, such as a polyester fiber, nylon fiber, or polyether ketone fiber, is irradiated with an infrared beam and is drawn while its thread is heated and softened at temperatures higher than a glass transition temperature. An apparatus for fabricating a fiber is provided with a means (10) for continuously feeding a thread (1) at a constant feed rate (v) and an infrared irradiation means (13) including a laser for irradiating the thread (1) with an infrared beam, interposed between the means (10) for feeding the thread and a fiber winding means (11) for winding the thread (1) at a winding rate (V) higher than the constant feed rate (v), in order to soften the thread (1) traveling to be fed and wound.

4 Claims, 6 Drawing Sheets

HIGH-STRENGTH SYNTHETIC FIBER AND METHOD AND APPARATUS FOR FABRICATING THE SAME

TECHNICAL FIELD

This invention relates to a synthetic fiber that has a high strength and a high elastic modulus and to a method and an apparatus for fabricating the fiber.

BACKGROUND ART

For a fiber material exhibiting clear crystal dispersion, such as polyethylene, chain entanglement is minimized and the material is drawn at temperatures over a crystal dispersion temperature. By doing so, a high-strength and high-elastic-modulus fiber can be fabricated. This method is published by Lemstra et al., DSM Corp., Holland, in 1979. Such fibers are commercially available as products termed DYNEEMA (registered trademark) and SPECTRA (registered trademark).

Since the method needs to drag a chain out of a crystal without breaking the crystal, it is indispensable to draw the material at temperatures over a crystal dispersion temperature. The method is very effective obtain high chain orientation for polymers in which the clear crystal dispersion is observed, for example, polyethylene, polypropylene, and polyvinyl alcohol. However, it is not suitable for fiber materials in which the clear crystal dispersion cannot be observed, such as polyester and nylon.

In contrast to this, there is a method to obtain highly molecular chain orientation that a fiber material, after being rapidly heated, is drawn instantaneously and is cooled and solidified is reported and is generally known as a zone drawing method or a zone drawing and annealing method. This method is that, in principle, a steep temperature gradient is produced along the thread and thereby the thread is drawn at a high strain rate to drag a chain. Since the thread is deformed at a relatively an high strain rate with respect to a progressing rate of orientation-induced crystallization, an uniform deformation with a high draw ratio is possible. A fiber thus available has a high strength and a high elastic modulus by itself, and, moreover, it has become possible that a high-strength and high-elastic-modulus fiber which has required multi-step drawing is produced through a single drawing process or a smaller number of drawing processes than in a conventional way.

Since the above method does not rely on a phase transition phenomenon, such as crystal dispersion, inherent in a polymer of raw material, but only the formation of a steep temperature gradient in an axial direction of the fiber, it is not governed by the kind of polymer in principle. The method is thus applicable to many fiber materials including polyester and nylon.

In a conventional fabrication process of a synthetic polymer fiber, the heating of the thread has been controlled directly by a contact heater such as a heat pin or a heat roller, or indirectly by adjusting an ambient temperature in a heating zone through a non-contacting heater. As an example of the ambience of the heating zone, air or steam is cited.

In such a method, since a heat transition is chiefly made by a heat transfer through a fiber surface, the efficiency of the heat transition is impaired and rapid heating is difficult. Furthermore, because the heat transition is made through the fiber surface, uniform heating is generally difficult. In particular, where the ambient temperature of the heating zone is elevated for the purpose of rapid heating, a remarkable temperature difference is produced in the cross section of the fiber and makes the fiber liable to cause uneven deformation and inhomogeneous structure. Since rapid and uniform heating is impossible, the deformation rate of the fiber is highly limited, and zone drawing and annealing with a high speed are difficult.

On the other hand, a method of utilizing not the heat transfer but the heat radiation of infrared rays in order to uniformly heat a thread is disclosed in each of Japanese Patent Provisional Publication Nos. Hei 4-281011 and Hei 5-132816, which suggests that the method has a constant effect on uniform heating of the thread. However, a difference between this method and the prior art relative thereto is only that a heat transition system is changed from the heat transfer to the heat radiation. Moreover, a device identical in size with a conventional heat tube is used to heat the thread over substantially the same length as in a conventional drawing and heat-setting technique with respect to the traveling direction of the thread. Hence, the amount of thermal energy applied to the thread per unit time is almost the same as that in the prior art, and the advantages of the zone drawing and annealing method of drawing the thread for d short time after rapid heating cannot be optimized. It is for this reason that although infrared rays are collected to some extent in a plane perpendicular to the traveling direction of the thread, they are not collected in the traveling direction of the thread, and the output of an infrared source per unit length of the thread is not so high as to allow rapid heating.

A method of irradiating a thread with an infrared beam from a carbon dioxide laser to fabricate a polyester fiber that possesses a high molecular orientation and low specific gravity is disclosed in Japanese Patent Provisional Publication No. Sho 61-75811. This publication shows that, by the method, a thread is rapidly heated with infrared radiation and thus a fiber that has a high molecular orientation and low specific gravity can be made. According to the embodiment of the method, the draw ratio of the thread is limited to 1.29–4.3, and a difference in specific gravity between fibers obtained by this method and a conventional method is slight. Moreover, it is described that high-temperature heat treatment is performed under high tension after drawing, and thereby a fiber that has a high strength to some extent can be obtained.

However, the fiber after drawing, set forth in the above publication, has no high strength or high elastic modulus so enough as is required in the fiber industry. The present invention provides a synthetic fiber that has a higher strength and a higher elastic module than a conventional high-strength and high-elastic-modulus synthetic fiber and a method and an apparatus for efficiently fabricating the synthetic fiber with such a higher strength and a higher elastic modulus.

DISCLOSURE OF THE INVENTION

The high-strength synthetic fiber of the present invention is fabricated in such a way that a fiber, such as a polyester fiber, nylon fiber, or polyether ketone fiber, is irradiated with an infrared beam and is drawn while its thread is heated and softened at temperatures higher than a glass transition temperature.

The high-strength synthetic fiber, when fabricated by drawing a polyester fiber, has an average refractive index of 1.58–1.69, and a difference in refractive index between two principal axis caused by double refraction, hereinafter being referred to as merely "a birefringence", is 0.16–0.24.

The high-strength synthetic fiber, when fabricated by drawing a polyester fiber, has a strength of 0.85–3 GPa (Giga Pascal).

The high-strength synthetic fiber is such that even when the fiber is dissolved in a solution of orthochlorophenol and the viscosity number of the solution measured on the basis of ISO 1628-5 is 0–0.65 dl/g, the strength of the fiber is still 0.85–3 GPa.

Further, the high-strength synthetic fiber, when fabricated by drawing a polyester fiber, has an initial elastic modulus of 18–40 GPa and a boil-off shrinkage of less than 4%.

The method of fabricating the high-strength synthetic fiber of the present invention is that while the material of a synthetic fiber obtained by melt spinning is made to travel at a speed of 0.1–150 meters per second, it is heated by irradiation of an infrared beam and is softened by raising fiber temperatures 20–300 K in an irradiation range so that the fiber is drawn by an external force and is wound on a reel.

The draw ratio for acquiring the high-strength fiber is 5–10 for a fiber with a birefringence of 0–0.005; 4–7 for 0.005–0.010; 3–6 for 0.010–0.020; and 1.8–5 for 0.020–0.200.

Before a process that the thread is heated and softened by the irradiation of the infrared beam, the thread may be preheated at temperatures somewhat lower than the above fiber temperatures.

The above fabricating method may also be repeated several times.

This fabricating method may be carried out so that a process for heating, softening, and drawing the thread follows a process for cooling and solidifying a thread melt-spun through a spinneret.

When the thread is heated, softened, and then drawn, vibration strain with an amplitude of 10–1000 $\mu$m and a frequency of 100–100000 kHz may be applied to the thread along the axial direction of the fiber.

For the irradiation of the infrared beam, it is desirable to use a coherent light source with a laser.

The fiber fabricating apparatus of the present invention is provided with a means for continuously feeding a thread 1 at a constant feed rate v and an infrared irradiation means including a laser for irradiating the thread 1 with an infrared beam, interposed between the feeding means and a fiber winding means 11 for winding a fiber at a winding rate V higher than the constant feed rate v, in order to soften the thread 1 traveling to be fed and wound.

The infrared irradiation means can be properly used when having a lens, a mirror, a prism, and/or a wave guide to conduct infrared rays emitted from the laser to a traveling thread.

It is favorable that the lens, the mirror, the prism, and/or the wave guide are disposed so that the entire circumference of the thread is irradiated with the infrared rays.

It is also favorable that the lens, the mirror, the prism, and/or the wave guide is disposed so that the infrared rays in the traveling direction of the thread are collected in an area in which the thread is softened, while the infrared rays in a direction perpendicular to the traveling direction of the thread are collected in an area equivalent to, or somewhat larger than, the thickness of the thread.

BEST MODE FOR CARRYING OUT THE INVENTION

Figure 1:
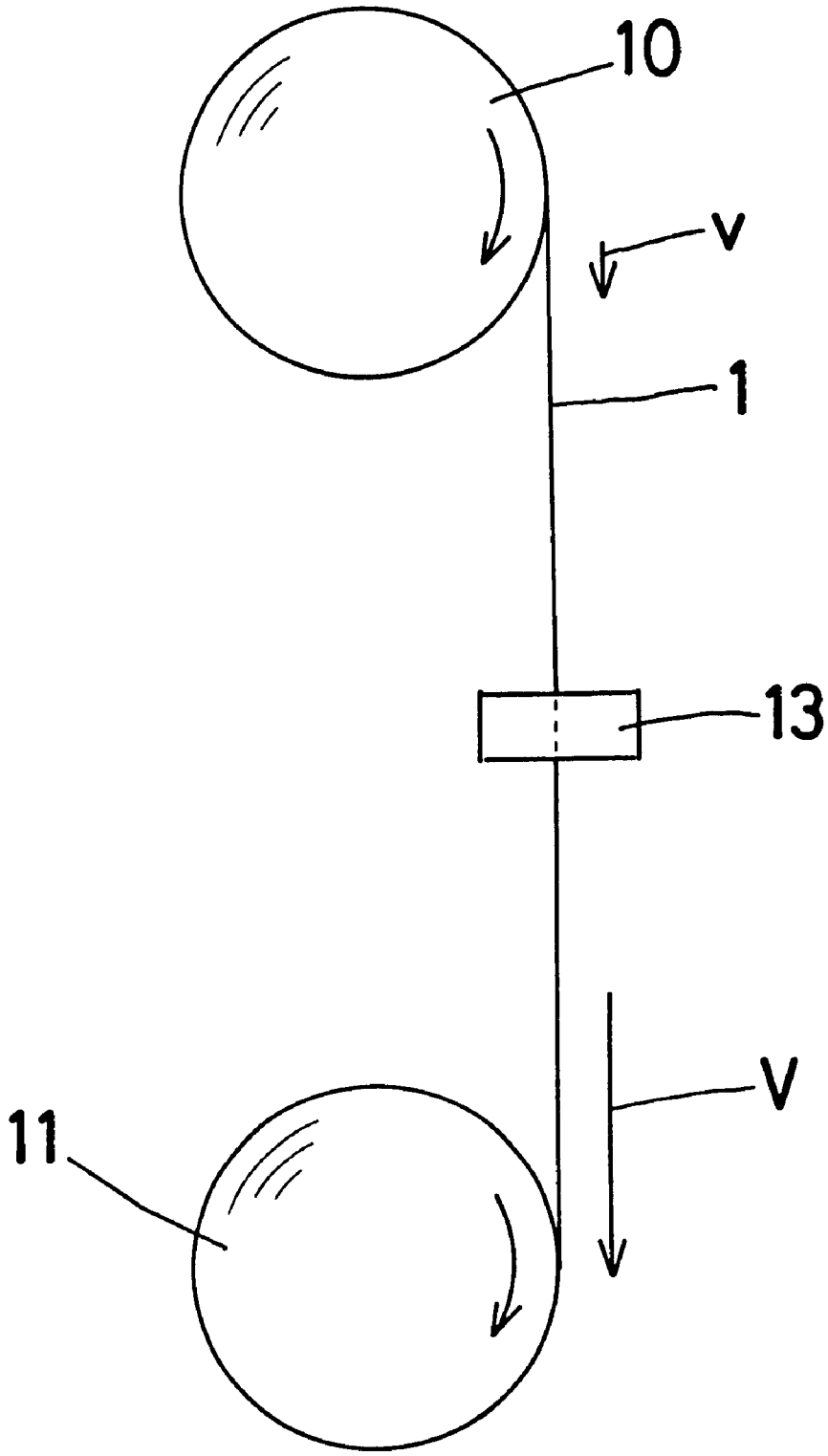
FIG. 1 is a view showing schematically the construction of one embodiment of an apparatus for fabricating a high-strength synthetic fiber in the present invention.

The high-strength synthetic fiber of the present invention is obtained by drawing a fiber, such as a polyester fiber, a nylon fiber, or a polyether ketone fiber. The polyester fiber of raw material is capable of using a melt-spinning fiber of polyester including ethylene terephthalate as a main repeating monomer unit or butylene terephthalate or tetramethylene terephthalate as a main repeating monomer unit. Polyester whose main repeating monomer unit is ethylene terephthalate contains terephthalic acid or its ester derivative as a main acid component and ethylene glycol as a main alcohol component, and may be such as to co-polymerize this component and a known acid component or alcohol component. As actual examples of acid components are cited dicarboxylic acids, such as isophthalic acid, naphthalenedicarboxylic acid, diphenyidicarboxylic acid, diphenyl sulfone dicarboxylic acid, adipic acid, sebacic acid, and 1,4-cyclohexanedicarboxylic acid or their ester derivatives; dicalboxylic acids containing metallic sulfonate group, such as sodium isophthalic acid-5-sulfonate, sodium isophthalic acid-2-sulfonate and sodium 1, 8-dicarboxynaphthalen-3-sulfonate, or their ester derivatives or potassium salt and lithium salt of these compounds; and oxycarboxylic acids, such as p-oxybenzoic acid and p-β-oxyethoxybenzoic acid, and their ester derivatives. As actual examples of alcohol components are cited lower alkylene glycol such as propylene glycol or butylene glycol; 1, 4-cyclohexanedimethanol; neopentyl glycol; 1, 4-bis (β-hydroxyethoxy) benzene; and bisglycol ether of bisphenol A. In the region in which polyester is substantially linear, polycarboxylic acid, such as trimellitic acid or pylomellitic acid, and polyol, such pentaerythritol, trimethylolpropane, or glyceline, or a polymerization inhibitor, such as monohydric polyalkylenoxide or phenylacetic acid, may be contained.

The nylon fiber of raw material is capable of using a melt-spinning fiber of nylon 6, nylon 66, or nylon 610, and may be such that this nylon component and a known acid component or an amine component are copolymerized.

The polyether ketone fiber of raw material is capable of using a melt-spinning fiber containing paraphenylene and an ether group or a ketone group as a main repeating monomer unit.

The high-strength synthetic fiber obtained by drawing the polyester fiber has an average refractive index of 1.58–1.69 and a birefringence of 0.1–0.24. The average refractive index is a parameter that can be expressed in terms of the density of the polyester fiber, and the birefringence is a parameter that indicates the degree of molecular orientation of the polyester fiber. The high-strength synthetic fiber that is the polyester fiber has a strength of 0.85–3 GPa, an initial elastic modulus of 18–40 GPa, and a boil-off shrinkage of less than 4%.

In general, as the viscosity number of the polyester fiber increases, the molecular weight increases. This tendency is favorable for heightening the strength of the fiber. On the other hand, the synthesis and fabrication of a fiber with high viscosity number are liable to be attended with difficulty and are unfavorable in view of cost. The high-strength fiber of the present invention is fabricated so that even when the viscosity number is 0–0.65 dl/g, the above strength and elastic modulus are maintained.

The fiber fabrication method of the present invention, as shown in FIG. 1, is such that a thread 1 is fed from a roll 10 at a constant feed rate v and is irradiated with an infrared beam through an infrared irradiation means 13 including a laser. By doing so, the thread 1 is heated and softened at temperatures over the glass transition temperature and is wound on a reel 11 at a winding rate V higher than the feed rate v, so that the thread 1 is drawn.

Figure 2:
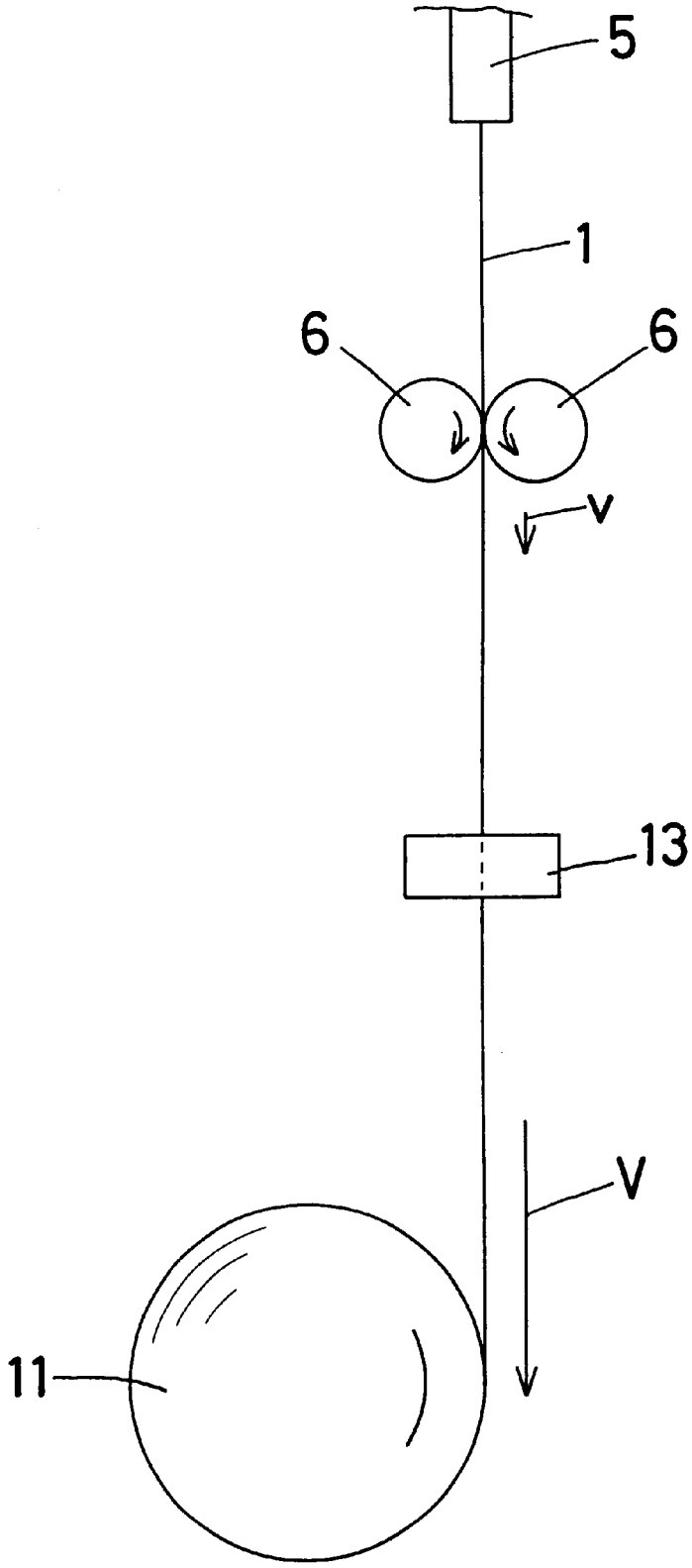
FIG. 2 is a view showing schematically the construction of another embodiment of the apparatus for fabricating a high-strength synthetic fiber in the present invention.

As shown in FIG. 2, a melt polymer which is a raw material of a synthetic fiber is extruded from a melt spinning nozzle 5, and the thread 1 cooled and solidified at temperatures below the glass transition temperature is held between a pair of rollers 6 and is pulled out and fed there from at the feed rate v. Subsequently, the thread 1 is softened by the infrared irradiation means 13 and is wound on the reel 11 at the winding rate V than the feed rate v. In this way, the thread 1 may be drawn.

The thread 1 is irradiated with the infrared beam and is rapidly heated, in a range of 0.1–100 mm along the traveling direction of the thread, so that the fiber temperature is raised 20–300 K within this range and the thread 1 is softened and drawn. Consequently, most of a true strain portion applied thread by drawing, typically at least 50% thereof, is contained in this heating region.

The thread is heated instantaneously at temperatures close to the glass transition temperature or at higher temperatures with respect to an undrawn fiber that is not virtually crystallized, or at temperatures close to a melting crystal temperature or at higher temperatures with respect to a fiber with a high degree of crystallization. The thread is drown instantaneously by an external force and thereby chains are highly oriented, bringing about a high-strength and high-elastic-modulus fiber. For the polyester fiber, nylon fiber, or polyether ketone fiber, since the structure of a fiber to be formed, notably the completeness of crystal, is affected by a drawing temperature, the drawing temperature is raised gradually for multistep drawings, and thereby a higher-strength and higher-elastic-modulus fiber can be obtained. In this case also, the orientation relaxation of chains can be suppressed by instantaneous heating and drawing.

On the other hand, preheating at temperatures below the glass transition temperature, performed before the heating region in which the thread is mainly drawn, from the roll 10 to the infrared irradiation means 13 in FIG. 1 or from the rolls 6 to the infrared irradiation means in FIG. 2, does not require a heating width and a heating system and may be any of contact conduction heating, radiation heating, and convection heating.

The high-strength synthetic fiber is obtained in such a way that the material of a synthetic fiber derived from the melt spinning, while being made to travel, is heated and softened by irradiation of the infrared beam, and the thread drawn by an external force is wound on a reel.

Also, the thread is not limited to a single fiber and may be a bundle of a plurality of fibers.

A light source for the infrared beam is one emitting an infrared wave-length of 0.7–100 $\mu$m, which is absorbed by the material of the synthetic fiber and serves to soften the thread. Specifically, it is a continuous spectral light source that utilizes a high-temperature heating element or a coherent light source that utilizes laser oscillation. A laser, because of its excellent property of collimating rays, facilitates the formation of collected light or a parallel beam and brings about a high output. The laser is capable of using a gas, a solid, a semiconductor, coloring matter, excimer, or a free electron as an emission source. Particularly excellent are a laser with an oscillation wavelength of 9–12 $\mu$m using carbon dioxide as an emission source and a laser with an oscillation wavelength of 0.9–1.2 $\mu$m using yttrium aluminium garnet ($3Y_2O_3.5Al_2O_3$) to which a trace of $Nd^{3+}$is added, as an emission source. Of these lasers, the carbon dioxide laser is effective for practical use because it emits radiation in a wavelength band in which a synthetic fiber material, such as polyester, nylon, or polyether ketone, exhibits strong absorption. Although it is desirable that its oscillation system is continuous, any pulse oscillation with a sufficiently high frequency is satisfactory. For example, if the traveling rate of the thread is 50 m/s and the length of the irradiation range along the traveling direction is 10 mm, interrupted oscillation with a frequency of at least 100 kHz can be thought of as continuous oscillation in practical use.

The amount of energy of infrared rays absorbed by the thread depends on the wavelength of the infrared rays and the diameter, traveling rate, density, thermal capacity, and infrared absorptive power of the thread. When a temperature rise due to infrared irradiation is represented by $\Delta T$ and it is assumed that the travel of the thread is in a steady state, the relation of $\Delta T=Q/WC$ is generally established. Here, Q is the amount of energy per unit time, absorbed by the thread in accordance with the irradiation, W is the mass flow rate of the thread, and C is the specific heat of the fiber material. When the energy of infrared rays per unit time, irradiating the thread is denoted by i, Q=Ki, where K is the absorptive power of infrared rays by the thread. As typical conditions, when it is assumed that K=0.3, the thread diameter=0.1 mm, the thread traveling rate=5 m/s, the specific heat=1.17 kJ/kg·K, and the density=1.32 $Mg/m^3$, $\Delta T$=5 i. In other words, when the thread is irradiated with infrared rays of 1 W, the temperature of the thread increases by 5 K. Thus, for example, under the above conditions, in order to rapidly heat the thread by 50 K with only the irradiation of an infrared beam within a range of 10 mm, it is necessary to irradiate the thread with an infrared beam of an average intensity of 10 $MW/m^2$.

The temperature of the thread is also raised by the deformation of the fiber itself. Hence, when the thread heated to temperatures close to the glass transition temperature is softened and drawn, a series of changes is brought about that the temperature of the thread is further raised by heat due to viscous deformation or plastic deformation and the fiber is further softened. This allows concentrated deformation within a very narrow range.

The irradiation range of infrared rays in the present invention refers to the range where the intensity of the infrared beam irradiated to the thread is more than $1/e^2$ of the maximum intensity irradiated to the thread. Here, is the base of natural logarithm.

When the thread is heated, softened, and then drawn, vibration strain with an amplitude of 10–1000 $\mu$m and a frequency of 100–100000 kHz may be applied to the thread along the axial direction of the fiber.

The fiber fabrication apparatus of the present invention, for example, as shown in FIG. 1, includes the means 10 for continuously feeding the thread 1 at the constant feed rate v and the infrared irradiation means 13 including the laser for irradiating the thread 1 with the infrared beam, interposed between the feeding means 10 and the fiber winding means 11 for winding the thread 1 at a higher traveling rate V than the constant feed rate v, in order to soften the thread 1 traveling to be fed and wound.

As shown in FIG. 2, the pair of rollers 6 is provided to turn and hold the synthetic fiber extruded from the melt spinning nozzle 5 and can also combine the reception of a melt spinning fiber at the feed rate v and the feed of the synthetic fiber of raw material.

FIGS. 3–10 show preferred examples relative to the infrared irradiation means 13 provided in the fiber fabrication apparatus of the present invention.

Figure 3:
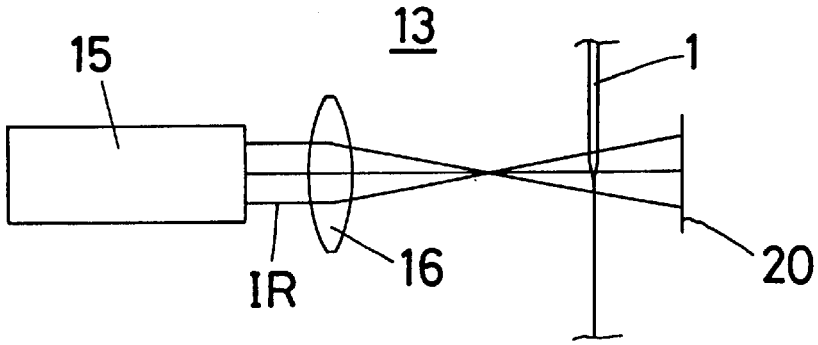
FIG. 3 is a view showing the detail of one example of an infrared irradiation means mounted to the apparatus for fabricating a high-strength synthetic fiber in the present invention.

In the example shown in FIG. 3, the infrared irradiation means 13 is designed so that infrared rays IR emitted from a laser 15 are collected by a lens 16. Although the thread 1 is located behind a focal point, it may be situated before the focal point. The position of the thread 1 is shifted from the focal point in this way, and thereby the irradiation range of the infrared rays IR is widened. Behind the thread 1, an air- or water-cooled light-absorbent plate 20 is provided to absorb infrared rays that the thread does not absorb. A heat-resisting element, such as a brick or a metal whose surface is roughed and coated with a heat-resisting film, is suitable for the material of the light-absorbent plate 20.

Figure 4:
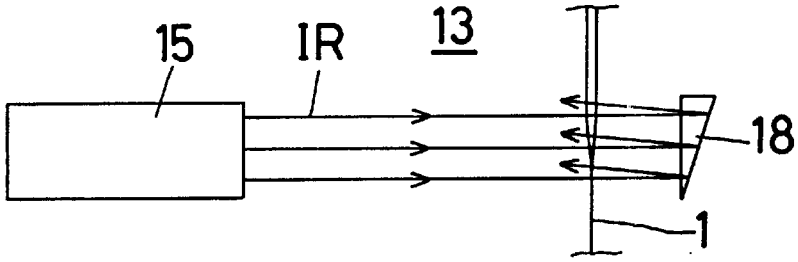
FIG. 4 is a view showing the detail of another example of the infrared irradiation means.

The infrared irradiation means 13 shown in FIG. 4 is such that the thread 1 is irradiated with the infrared rays IR from the laser 15 as parallel rays. Behind the thread 1, a prism 18 is provided for the purpose that the infrared rays IR which are not absorbed by the thread 1 are returned to the thread 1 by shifting and reflecting the rays toward the traveling direction of the thread 1 to thereby widen the irradiation range of the thread 1 in the traveling direction.

Figure 5:
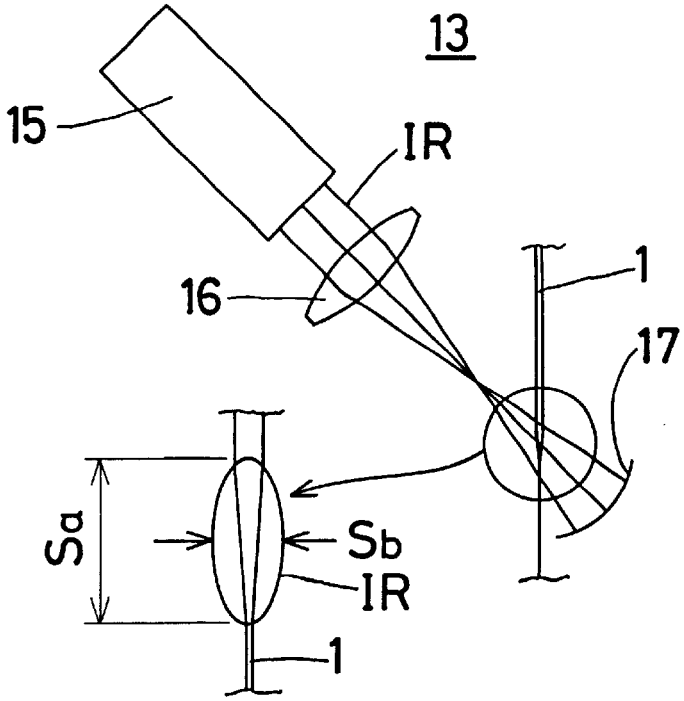
FIG. 5 is a view showing the detail of still another example of the infrared radiation means.

In the example shown in FIG. 5, the infrared irradiation means 13 is such that the infrared rays IR from the laser 15 are collected by the lens 16 and the infrared rays IR which the thread 1 does not absorb are reflected and collected by a concave mirror 17 and are returned to the thread 1. Furthermore, in this example, the optical axis of the infrared irradiation means 13 is inclined with respect to a direction perpendicular to the traveling direction of the thread 1 and thereby the irradiation range of the infrared rays IR is formed into an ellipse with its major axis along the traveling direction of the thread 1. An irradiation range Sb of the infrared rays IR in the direction perpendicular to the traveling direction of the thread 1 is made somewhat larger than the thickness of the thread 1, and an irradiation range Sa of the infrared rays IR in the traveling direction of the thread 1 is set to such an extent that the thread 1 is softened. Thus, the energy of the infrared rays is efficiently utilized.

Figure 6:
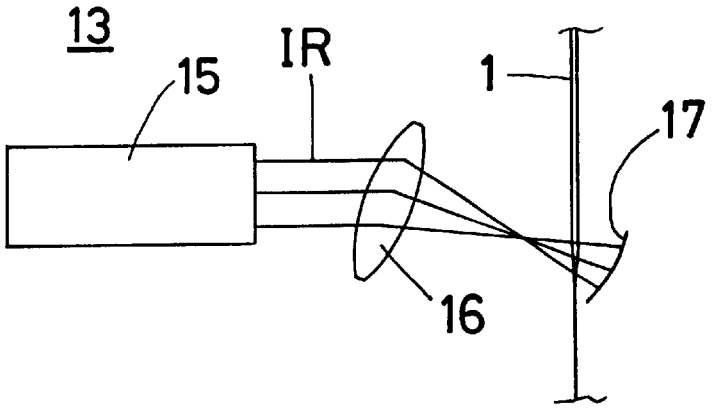
FIG. 6 is a view showing the detail of a further example of the infrared radiation means.

In the example of FIG. 6, the infrared irradiation means 13 is such that the infrared rays IR from the laser 15 are collected by the lens 16 whose optical axis is inclined, and the infrared rays IR which the thread 1 does not absorb are reflected and collected by the concave mirror 17 and are returned to the thread 1. Because the optical axis of the lens 16 is inclined, the irradiation range of the infrared rays IR, as shown in FIG. 5, can be formed into an ellipse with its major axis along the traveling direction of the thread 1.

Figure 7:
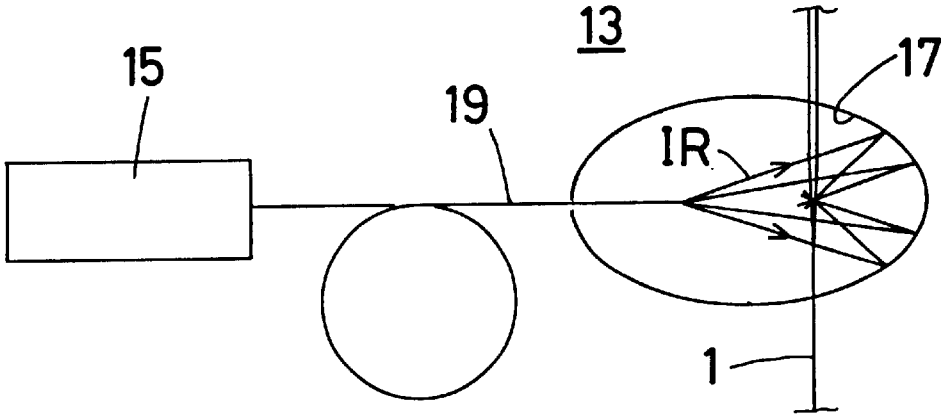
FIG. 7 is a view showing the detail of another example of the infrared radiation means.

In the infrared irradiation means 13 shown in the example of FIG. 7, the infrared rays IR from the laser 15 are introduced into the spheroid mirror 17 by an optical fiber 19 that is a wave guide. The exit end of the optical fiber 19 is located at the first focal point of a spheroid, and the drawn part of the thread 1 is situated close to the second focal point thereof. Consequently, the thread 1 can be efficiently heated.

Figure 8:
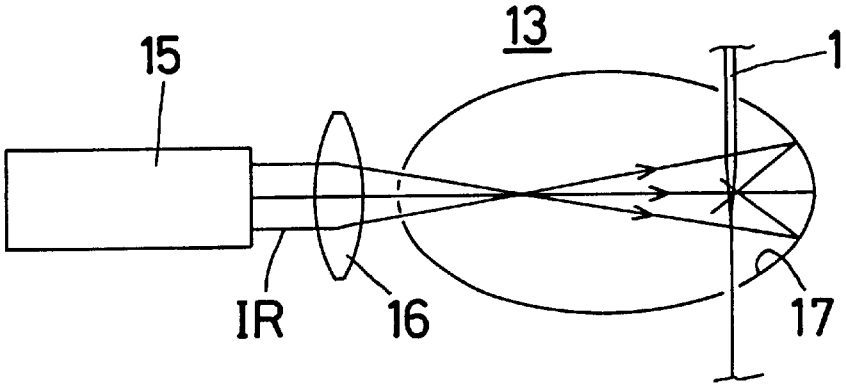
FIG. 8 is a view showing the detail of another example of the infrared radiation means.

In the infrared irradiation means 13 shown in the example of FIG. 8, the infrared rays IR from the laser 15 are introduced by the lens 16 into the spheroid mirror 17. The focal point of the lens 16 is located at the first focal point of the spheroid, and the drawn part of the thread 1 is situated close to the second focal point.

Figure 9:
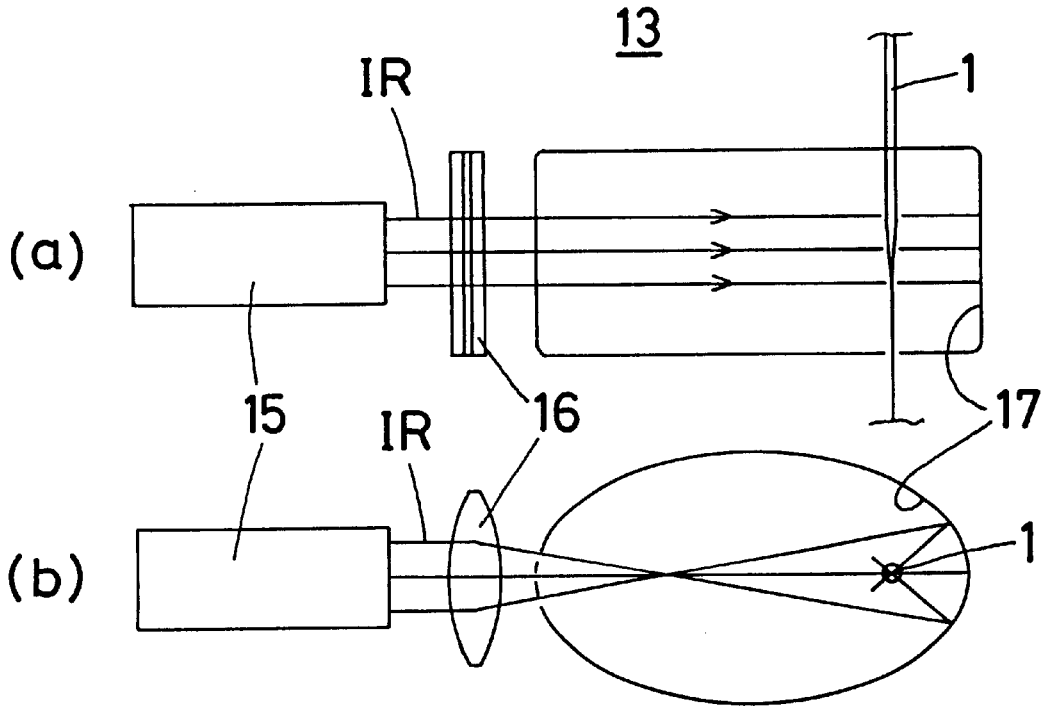
FIG. 9 is a view showing the detail of another example of the infrared radiation means.

In the example shown in FIG. 9, the infrared irradiation means 13 is such that the infrared rays IR from the laser 15 are introduced by the cylindrical lens 16 into the elliptical cylindrical mirror 17. The focal point of the cylindrical lens 16 is located at the first focal point of the elliptical cylindrical mirror 17, and the drawn part of the thread 1 is situated close to the second focal point. Therefore, the infrared irradiation means 13 has no lens function or concave-mirror function in the traveling direction of the thread 1, and the thread 1 is irradiated lengthwise with the infrared rays IR. The infrared rays IR are collected in the direction perpendicular to the traveling direction of the thread 1 by the lens function of the cylindrical lens 16 and the concave-mirror function of the elliptical cylindrical mirror 17. The thread 1 is irradiated with the infrared rays IR, lengthwise in the traveling direction and on the entire circumference of the thread 1, which is favorable.

Figure 10:
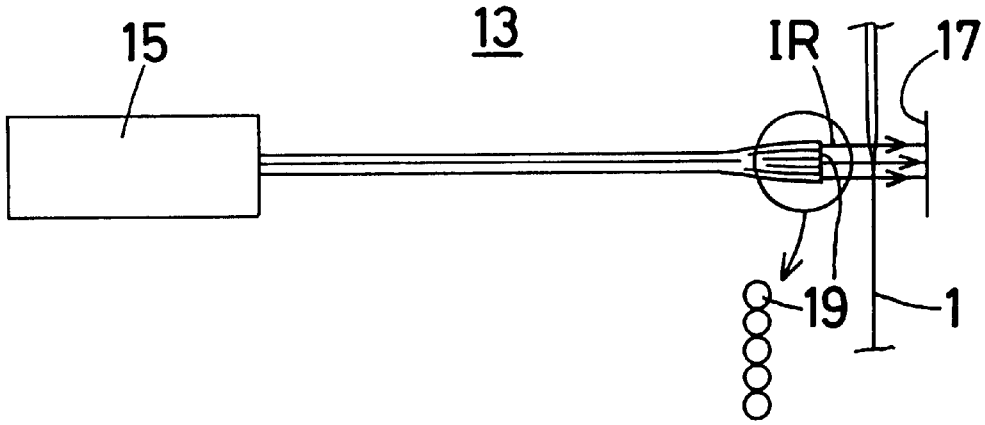
FIG. 10 is a view showing the detail of another example of the infrared radiation means.

In the example shown in FIG. 10, the infrared irradiation means 13 is such that the thread 1 is irradiated with the infrared rays IR from the laser 15 through the solid wave-guide 19. The wave guide 19 has a single entrance end with respect to the laser 15 and exit ends arranged like a plurality of layers along the traveling direction of the thread 1 on the side of the thread 1. The thread 1 is thus irradiated lengthwise with the infrared rays IR in the traveling direction of the thread 1, but it is irradiated in accordance with the width of the single entrance end of the wave guide 19 in the direction perpendicular to the traveling direction of the thread 1. Hence, efficient heating can be performed.

It is necessary that the lens 16 and the prism 18, as well as the wave guide 19 and the mirror 17, are made from materials that transmit or reflect infrared rays. In the former case of transmission, when wavelengths are 9–12 $\mu$m, zinc selenide, silicon, germanium, and chalcogens glass can be used. When wavelengths are 0.9–1.2 $\mu$m, quartz, lithium fluoride, barium fluoride, and fluoride glass can be employed. In the latter case of reflection, a metallic mirror can be cited. A hollow tube whose inside is coated with a reflection film can also be used as the wave guide 19.

The embodiments of the present invention will be described below. However, the present invention is not limited to these embodiments.

Each of embodiments uses a fiber fabricated through melt spinning of polyethylene terephthalate used as a raw fiber under the following conditions: a spinning temperature of 280° C., a nozzle diameter of 0.5 mm, 1 hole (L/D=5), a discharge rate of 4.95 grams per minute, and a winding rate of 250 meters per minute. This fiber has a diameter of 145 μm, a bire-fringence of 0.001, a strength of 90 MPa, and an elastic modulus of 2.0 GPa. The viscosity numbers measured by using orthochlorophenol on the basis of ISO 1628-5 are 0.62 dl/g in Examples 1–9 and Comparative examples and 0.87 dl/g in Examples 10 and 11.

The drawing conditions common to respective Examples are as follows: The light source is a carbon dioxide laser, which has an oscillation wavelength of 10.6 μm, a beam diameter of 5.0 mm, and a beam spread angle of 1.0 m rad. In the infrared irradiation means 13 shown in FIG. 3, a beam is condensed by the lens. The focal lengths of lenses are 127 mm in Examples 1–5 and Comparative examples and 50 mm in Examples 6–11. The thread is located behind the focal point and is made to travel in a direction perpendicular to the optical axis of the laser. The output of laser and the beam diameter at the position of irradiation thereof are as shown in Table 1.

In each of the measuring tests of strengths, elongation at breaking point, and initial elastic modulus in respective Examples and Comparative examples, a fiber sample whose holder is reinforced with paper and an adhesive is held with an initial chuck space of 40 mm, and a single tension test is made at a rate of 0.67 mm/s. From a stress-strain curve thus obtained, nominal stress and strain are read, and are used for calculation. The initial elastic modulus is found from a gradient at a point where the value of strain is zero, and the strength and the elongation at breaking points from the values of stress and strain at a breaking point. The refractive indices in directions parallel and perpendicular to the fiber axis are measured by an interference microscope made by Carl Zeiss, and the birefringence and the average refractive index are calculated from these values. An immersion liquid is a mixture of methylene iodide, α-bromonaphtalene, and bromobenzene, and the refractive index is measured by an Abbe refractometer made by Atago. A crystal orientation factor refers to the degree of orientation for the principal axis of orientation calculated from the orientation of (200) surfaces of crystal obtained by a wide-angle X-ray diffraction measurement. The boil-off shrinkage of the sample is measured on the basis of JIS-L-1073. The viscosity number of the sample before drawing is measured with respect to orthochlorophenol through a method defined by ISO 1628-5.

Fabrication conditions and test results in respective Examples and Comparative examples are listed in Table 1.

TABLE 1

| | Thread feed rate ($ms^{-1}$) | Thread winding rate ($ms^{-1}$) | Draw ratio | Laser beam power (W) | Laser beam dia. (mm) | Remarks | Boil-off shrinkage (%) | Strength (GPa) | Elongation at breaking point (%) | Initial elastic mod. (GPa) | Crystal orien-tation factor | Average refractive index | Index differ-ence |
|---|---|---|---|---|---|---|---|---|---|---|---|---|---|
| Example 1 | 0.245 | 1.72 | 7 | 22.5 | 2.1 | | | 0.71 | 10 | 15 | | 1.60 | 0.164 |
| Example 2 | 0.177 | 1.23 | 7 | 22.5 | 4.1 | | | 0.77 | 13 | 17 | | 1.60 | 0.173 |
| Example 3 | 0.177 | 1.06 | 6 | 22.5 | 4.1 | | | 0.6 | 16 | 14 | | 1.60 | 0.174 |
| Example 4 | 0.15 | 0.165 | 6.6 | 13.8 | 4.1 | a | | 0.73 | 16 | 15 | | | |
| Example 5 | 0.192 | 1.06 | 5.5 | 22.5 | 4.1 | | | | | | | | 0.16 |
| Example 6 | 0.267 | 1.60 | 6 | 22.5 | 4 | | 6.8 | 0.88 | 18 | 19.3 | 0.986 | 1.59 | 0.208 |
| Example 7 | 0.233 | 1.40 | 6 | 22.5 | 4 | | 3.9 | 0.85 | 19 | 18.4 | 0.980 | 1.59 | 0.215 |
| Example 8 | | | | | | b | 1 | 0.96 | 18 | 19.2 | 0.981 | 1.60 | 0.212 |
| Example 9 | | | | | | c | 1.3 | 1.18 | 12 | 20.8 | 0.988 | 1.61 | 0.22 |
| Example 10 | 0.133 | 0.80 | 6 | 22.5 | 4 | | 5.6 | 1.11 | 20 | 18.1 | 0.980 | 1.58 | 0.202 |
| Example 11 | | | | | | c | 1.5 | 1.28 | 12 | 19.5 | 0.988 | 1.60 | 0.21 |
| Comp. Ex. 1 | 0.125 | 0.75 | 6 | 22.5 | 4.1 | | | | | | | | 0.015 |
| Comp. Ex. 2 | | | 1 | | | d | | 0.09 | 1080 | 2 | | 1.58 | 0.001 |
| Comp. Ex. 3 | 0.01 | 0.07 | 7 | | | | | 0.22 | 106 | 3.3 | | 1.58 | 0.059 |
| Comp. Ex. 4 | 0.01 | 0.04 & 0.0175 | 7 | | | a | | 0.66 | 8 | 14 | | 1.60 | 0.175 |
| Comp. Ex. 5 | 0.01 | 0.04 & 0.015 | 6 | | | a | | 0.67 | 13 | 14 | | 1.60 | 0.179 |

Note: a=two-step drawing, b=Fixed-length annealing, c=tensioned annealing, d=Un-drawn

EXAMPLE 1

A high-strength synthetic fiber is fabricated experimentally in such a way that a thread is drawn by infrared heating on the conditions of Table 1 and is wound on a reel at a speed of 1.72 meters per second. In this case, a production speed is about 100 times higher and the temperature gradient is at least 10 times larger than in ordinary zone drawing. For physical properties of a high-strength synthetic fiber thus obtained, the strength is 3.2 times and the initial elastic modulus is 4.5 times higher than in the sample of Comparative example 3 in which the thread is drawn 7 times like an ordinary drawing condition. Even in comparison with the sample of Comparative example 4 in which the thread is drawn 7 times at two steps, the strength increases 1.08 times, the initial elastic modulus 1.07 times, and the elongation at breaking point 1.25 times.

EXAMPLE 2

The same thread as in Example 1 is drawn by infrared heating on the conditions of Table 1. As a result, the strength of the high-strength synthetic fiber increases 3.5 times and the initial elastic modulus increases 5.2 times in comparison with the sample fiber of Comparative example 3 in which the thread is drawn 7 times on the ordinary drawing condition. Even in comparison with the sample fiber of Comparative example 4 in which the thread is likewise drawn 7 times at two steps, the strength increases 1.17 times, the initial elastic modulus 1.21 times, and the elongation at breaking point 1.63.

EXAMPLE 3

The same thread as in Example 1 is drawn by infrared heating on the conditions of Table 1. A high-strength synthetic fiber thus available has the strength 2.7 times and the initial elastic modulus 4.2 times higher, in spite of the fact that the draw ratio is 6 times lower, than in the sample fiber of Comparative example 3 in which the thread is drawn 7 times on the ordinary drawing condition. In comparison with the sample of Comparative example 4 in which the thread is drawn 7 times at two steps, the initial elastic modulus is the same, in spite of the fact that the draw ratio decreases 6 times. Although the strength somewhat decreases 0.91 times, the elongation at breaking point increases twice. An increase of the elongation at breaking point implies that there is the possibility that the strength and the elastic modulus are further improved when the thread is further drawn.

EXAMPLE 4

The high-strength synthetic fiber obtained in Example 3 from the same thread as in Example 1 is drawn once more by infrared heating on the conditions of Table 1. As a result, in comparison with the sample of Comparative example 4 in which the thread is drawn 7 times at two steps on the ordinary drawing condition, the strength increases 1.11 times and the initial elastic modulus increases 1.07 times, in spite of the fact that the draw ratio is somewhat low. Nevertheless, a fiber that still holds the elongation at breaking point twice that of Comparative example 4 is obtained. When compared with Example 3, the strength increases 1.22 times, the initial elastic modulus increases 1.07 times, and the elongation at breaking point has a nearly equal value. From this result, it is verified that a high-strength synthetic fiber is fabricated in such a way that the thread is irradiated with the infrared beam and after being rapidly heated, is drawn to a high draw ratio, and when the fiber is further drawn, the strength and the initial elastic modulus can be improved.

EXAMPLE 5

Figure 11:
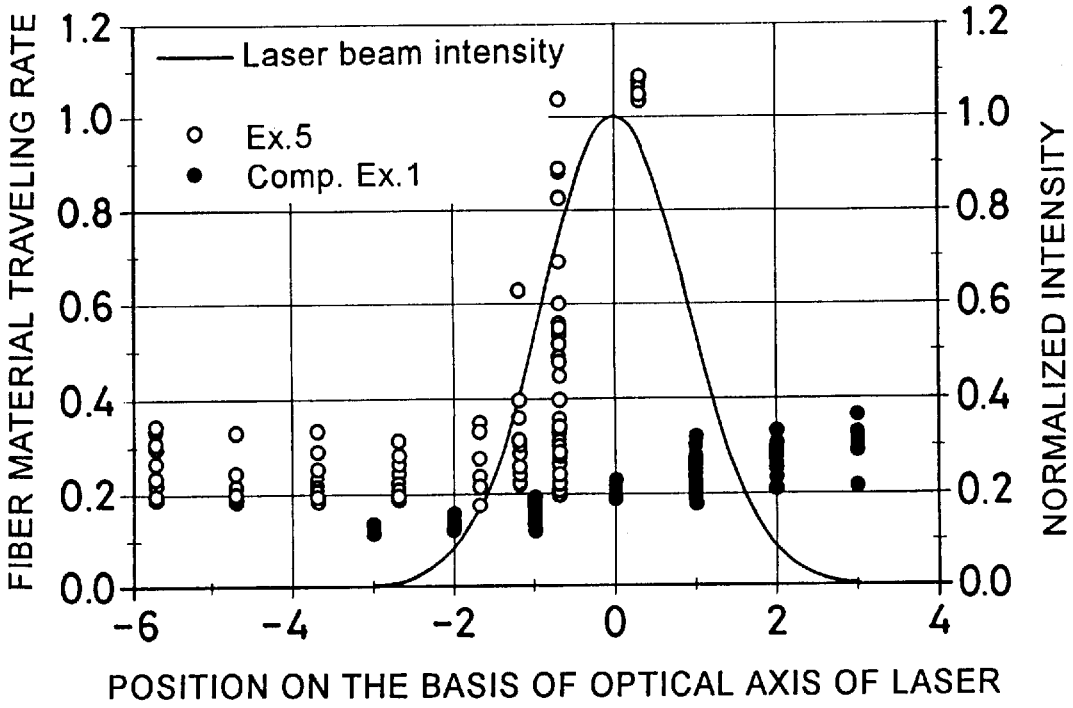
FIG. 11 is a diagram showing a thread traveling-rate distribution where a thread is drawn.

The same thread as in Example 1 is drawn by infrared heating on the conditions of Table 1. Since a high-strength synthetic fiber thus available has a birefringence of 0.16, it is found that chains are highly oriented. A thread traveling-rate distribution where the thread is drawn on this condition is shown in FIG. 11. In this graph, the axis of abscissas represents a distance measured along the traveling direction of the thread, with an origin at the position of the optical axis of a carbon dioxide laser beam, and the axis of ordinates represents a thread traveling rate. Each plot corresponds to the most frequent value of the thread feed rate for three seconds within ±1.5 mm, with each point as a center. Each mark o denotes a measured value of the thread feed rate or fiber winding rate in Example 5, and a solid line denotes the intensity distribution of a laser beam in which the intensity at the center is normalized. The thread traveling rate changes rapidly from the thread feed rate to the fiber winding rate at the position where the thread is located about 1 mm before the optical axis of the carbon dioxide laser. Not only does this indicate that a rapid neck-like change of diameter is brought about, but also it means that a drawing starting point and a drawing finishing point are fixed accurately within a range of no more than 1 mm from the optical axis. The drawing finishing point, as well as the drawing starting point, is contained in a laser irradiation range and thus this assumes typical zone drawing. Since this drawing condition is similar to those of Examples 1–3, it can be interpreted that the typical zone drawing occurs even in each of Examples 1–3.

EXAMPLES 6 and 7

The same thread as in Example 1 is drawn by infrared heating on the conditions of Table 1. The initial elastic modulus is 1.38 times, the strength is 1.31 times, and the elongation at breaking point is 1.46 times higher than in the sample of Comparative example 5 in which the thread is drawn 6 times at two steps.

EXAMPLE 8

The sample (already drawn) of Example 7 is heat-treated for one hour at a temperature of 160° C. in a state of a constant length. The strength and the initial elastic modulus are both improved when compared with those of the sample of Example 7.

EXAMPLE 9

The sample (already drawn) of Example 7 is heat-treated for three hours at a temperature of 240° C. in a state where 90% of the maximum compressive stress is applied to the sample. The strength and the initial elastic modulus are further improved when compared with the case where heat treatment is performed in a state of a constant length.

EXAMPLE 10

A fiber material using a polyester chip with a viscosity number of 0.935 dug is drawn by infrared heating on the conditions of Table 1. A fiber thus obtained has a viscosity number of 0.87 dl/g. A polymer with high viscosity number is used and thereby a polyester fiber that has a higher strength is obtained.

EXAMPLE 11

The sample (already drawn) of Example 10 is heat-treated for three hours at a temperature of 240° C. in a state where 90% of the maximum compressive stress is applied to the sample. The intensity and the elastic modulus are further improved than in Example 10.

For a sample obtained in each of Examples 6–11, the boil-off shrinkage, which are important for practical use, and the crystal orientation are measured. It is seen from each of Examples 8, 9, and 11 that the boil-off shrinkage is reduced to as low as 1% by heat treatment. Even with the fiber material using the polyester chip whose viscosity number is not very high, a fiber with appreciably high strength and high elastic modulus is obtained. Not only does this give a merit in fabrication cost, but also it can keep a decrease in physical property minimum when a recycle stock is used. In any sample, the crystal orientation factor is at least 0.980.

COMPARATIVE EXAMPLE 1

A thread is drawn by infrared heating on the conditions of Table 1. Since the thread feed rate is lower than that of Example 5 and the amount of energy of laser light for irradiating a traveling fiber is increased, the temperature of the thread is higher than that of Example 5.

A polyester fiber thus obtained has a low molecular orientation, and its initial elastic modulus and strength are low. A thread traveling-rate distribution under these conditions is shown in FIG. 1, using marks •. The thread is deformed by as low as 50% of the total amount of true strain even at a distance of 5 mm from the optical axis. The polyester fiber obtained has a low molecular orientation and assumes typical flow drawing. Here, the flow drawing refers to a state of drawing where the polymer is drawn at temperatures considerably higher than the glass transition temperature. In general, the molecular orientation is not so high and the initial elastic modulus and the strength are low.

The average refractive index of each of Examples 1–3 is equal to that of each of Comparative examples 4 and 5. Between the average refracfive index and the density, the called Lorentz-Lorenz equation is generally established. From the relationship between the average refractive index and the density of polyethylene terephthalete, an average refractive index of 1.60 corresponds to a fiber density of 1.387 g/cm$^3$. Thus, the fiber shown in each of Examples 1–3 does not correspond to the condition, $\Delta n<8$ SG−10.65, where $\Delta n$ is a birefringence and SG is a density, of a high orientation and low-specific-gravity polyester fiber disclosed in Japanese Patent Provisional Publication No. Sho 61-75811, and then they are different matters.

COMPARATIVE EXAMPLE 2

An undrawn polyester fiber is used.

COMPARATIVE EXAMPLE 3

A thread fed at a feed rate of 0.07 m/s is continuously drawn 7 times as long as the original thread in silicon oil at a temperature of 115° C.

COMPARATIVE EXAMPLES 4 and 5

A thread fed at a feed rate of 0.01 m/s is continuously drawn 4 times as long as the original thread in silicon oil at a temperature of 80° C. After that, the thread is fed at a feed rate of 0.01 m/s and is continuously drawn 1.75 and 1.5 times in silicon oil at a temperature of 163° C. The thread of each of Comparative examples 4 and 5 is drawn at the minimum temperature at which the thread can be steadily drawn to a preset draw ratio, and thus it can be expected that the optimum molecular orientation is obtained on each condition and the physical properties are also optimized.

Figure 12:
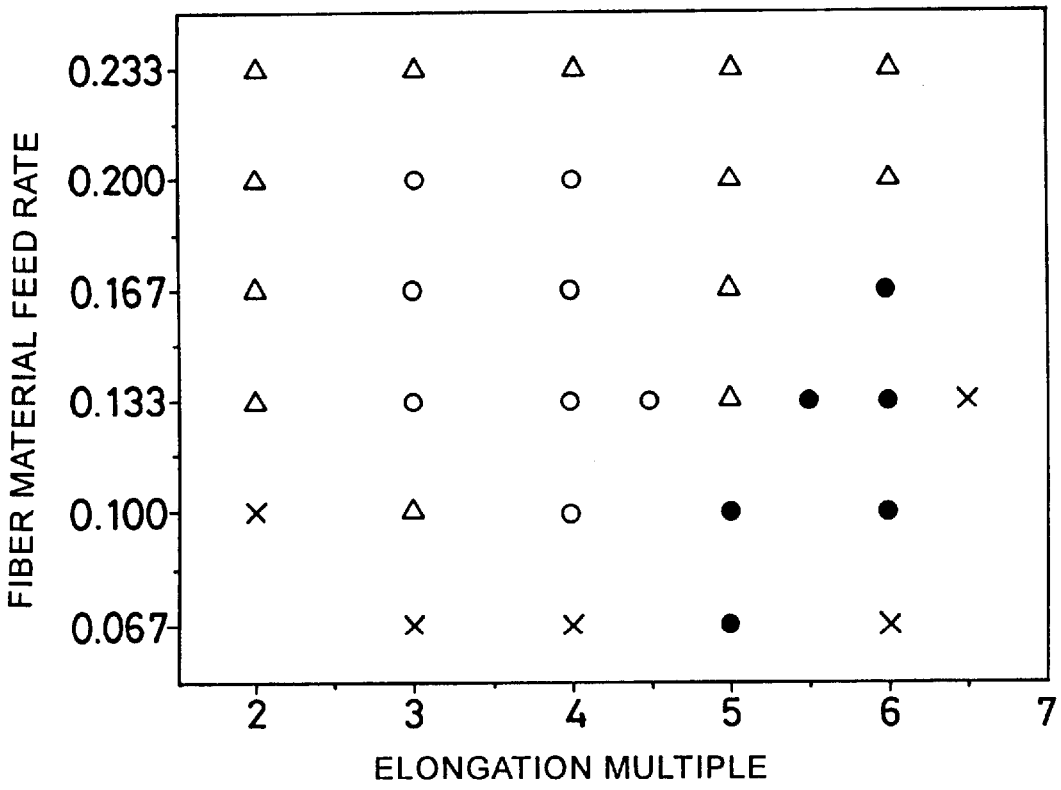
FIG. 12 is a diagram showing a result in the relationship between the draw ratio and the thread feed rate.

An alternative experiment is performed to attempt the applications of various draw ratios and thread feed rates on the drawing conditions common to fibers of the above raw materials and to find the conditions under which the thread can be steadily drawn and a high-strength and high-elastic-modulus fiber is obtained. The result is shown in FIG. 12. In this diagram, marks x represent conditions where the thread cannot be drawn and marks Δ represent conditions where the thread can be drawn, but the fluctuation range of the drawing point position is in excess of 0.2 mm. Marks • and α denote conditions where the fluctuation range of the drawing point position is within 0.2 mm. In each mark •, the birefringence of a fiber after drawing reaches at least 0.160, and a high-strength and high-elastic-modulus fiber is obtained. When the draw ratio is less than 5, the region in which the thread can be steadily drawn is shifted to the lower side of the thread feed rate as the draw ratio become high. However, when the draw ratio is more than 5, this region is rather shifted to the higher side of the thread feed rate as the draw ratio become high. Moreover, when the draw ratio is more than 5, the birefringence of a fiber after drawing reaches at least 0.160 and the crystal orientation factor becomes at least 0.980. Then the fiber itself is a high-strength synthetic fiber, which can also obtained by the furthermore step drawing and heat treatment. Thus, the condition of a draw ratio of at least 5 is very favorable. However, the draw ratio for obtaining such a high-strength synthetic fiber is governed by the birefringence of the fiber before drawing. When the birefringence of the fiber before drawing is 0–0.005, a high-strength synthetic fiber is obtained by drawing with a draw ratio of 5–10 as mentioned above. Similarly, a high-strength synthetic fiber is obtained by drawing with a draw ratio of 4–7 when the birefringence of the fiber before drawing is 0.005–0.010, by drawing with a draw ratio of 3–6 when the birefringence of the fiber before drawing is 0.010–0.020, or by drawing with a draw ratio of 1.8–5 when the birefringence of the fiber before drawing is 0.020–0.200.

INDUSTRIAL APPLICABILITY

The high-strength synthetic fiber of the present invention, in contrast with a conventional high-strength synthetic fiber, is capable of increasing the strength and the elastic modulus. In order to fabricate a fiber that has a high strength and a high elastic modulus, many manufacturing processes have been required in the past. However, according to the fabrication method of the high-strength synthetic fiber of the present invention, even when the polymer of raw material whose viscosity number is not very high is used, a synthetic fiber can be efficiently fabricated with an extremely high strength and high elastic modulus. Thus, such synthetic fibers can be mass-produced at low cost. Furthermore, the fabrication apparatus of the high-strength synthetic fiber is simply constructed and is capable of saving the energy of heating to fabricate a high-strength synthetic fiber.

What is claimed is:

1. A high-strength synthetic fiber comprising a fiber material of polyester fiber having an initial elastic modulus of 18–40 Giga Pascal and a boil-off shirnkage of less than 4%, that is fabricated by being irradiated with an infrared beam and being drawn while a thread thereof is heated and softened at temperatures higher than a glass transition temperature.

2. The high-strength synthetic fiber according to claim 1, wherein said high-strength synthetic fiber from the polyester fiber has an average refractive index of 1.58–1.69 and a birefringence of 0.160–24.

3. The high-strength synthetic fiber according to claim 1, wherein said high-strength synthetic fiber from the polyester fiber and has a strength of 0.85–3 Giga Pascal.

4. The high-strength synthetic fiber according to claim 3, wherein said high-strength synthetic fiber from the polyester fiber of which has a viscosity number of 0–0.65 dug measured a solution dissolved in orthochlorophenol on the basis of ISO1628-5.

* * * * *